United States Patent [19]

Chesnut et al.

[11] Patent Number: 4,790,094

[45] **Date of Patent: * Dec. 13, 1988**

[54] SIDE-BY-SIDE CARTRIDGE MAGAZINE FOR RIM-FIRE CARTRIDGES

[75] Inventors: M. Gaines Chesnut, Kremmling; Thomas L. Castetter, Elizabeth, both of Colo.

[73] Assignee: Pam-Line, Inc., Golden, Colo.

[ * ] Notice: The portion of the term of this patent subsequent to Jun. 16, 2004 has been disclaimed.

[21] Appl. No.: 937,360

[22] Filed: Dec. 3, 1986

Related U.S. Application Data

[63] Continuation-in-part of Ser. No. 805,303, Dec. 4, 1985, Pat. No. 4,672,760.

[51] Int. Cl.[4] ..... F41C 25/02

[52] U.S. Cl. ..... 42/50

[58] Field of Search ..... 42/50

[56] References Cited

U.S. PATENT DOCUMENTS

| | | | |
|---|---|---|---|
| 1,158,981 | 11/1915 | Carl | 42/50 |
| 1,833,862 | 11/1931 | Schmeisser | 42/50 |
| 2,217,848 | 10/1940 | Schillstrom | 42/50 |
| 2,655,754 | 10/1953 | Brush | 42/50 |
| 3,345,771 | 10/1967 | Silsby | 42/50 |
| 3,399,480 | 9/1968 | Rowe, Jr. | 42/50 |
| 3,604,142 | 9/1971 | Silsby | 42/50 |
| 3,952,441 | 4/1976 | Tant | 42/50 |
| 3,977,114 | 8/1976 | Poor | 42/50 |
| 4,112,817 | 9/1978 | Bourlet | 89/33 |
| 4,127,954 | 12/1978 | Hausmann | 42/50 |
| 4,566,212 | 1/1986 | Chesnut | 42/50 |
| 4,589,218 | 5/1986 | Teppa | 42/50 |
| 4,672,760 | 6/1987 | Chesnut et al. | 42/50 |

FOREIGN PATENT DOCUMENTS

| | | | |
|---|---|---|---|
| 90189 | 3/1896 | Fed. Rep. of Germany | 42/18 |
| 3305772 | 7/1983 | Fed. Rep. of Germany | 42/50 |

*Primary Examiner*—Charles T. Jordan

*Attorney, Agent, or Firm*—Sheridan, Ross & McIntosh

[57] ABSTRACT

A magazine is provided for housing a predetermined number of rim-fire cartridges in a double column configuration with minimal magazine width and length requirements. The magazine is configured so that the rims of the cartridges are automatically placed in a nested or staggered relationship when they are inserted and are maintained in that relationship as they move through the housing, so as to prevent cross over of the rims and jamming. The nested, side-by-side positional relationship of the cartridges in the magazine is changed to a single file relationship while the lateral force exerted on the cartridges is controlled and jamming caused by friction or deformation is prevented. The magazine has an arcuate shape with one end wall having a portion defined by a radius of about 5.29 inches. Three rails are positioned on the upper portion of one side wall. Rails and baffles are configured to avoid or reduce interference of debris or wax build-up. A method for making the magazine by injection molding parts to produce the desired rail structure is included.

13 Claims, 10 Drawing Sheets

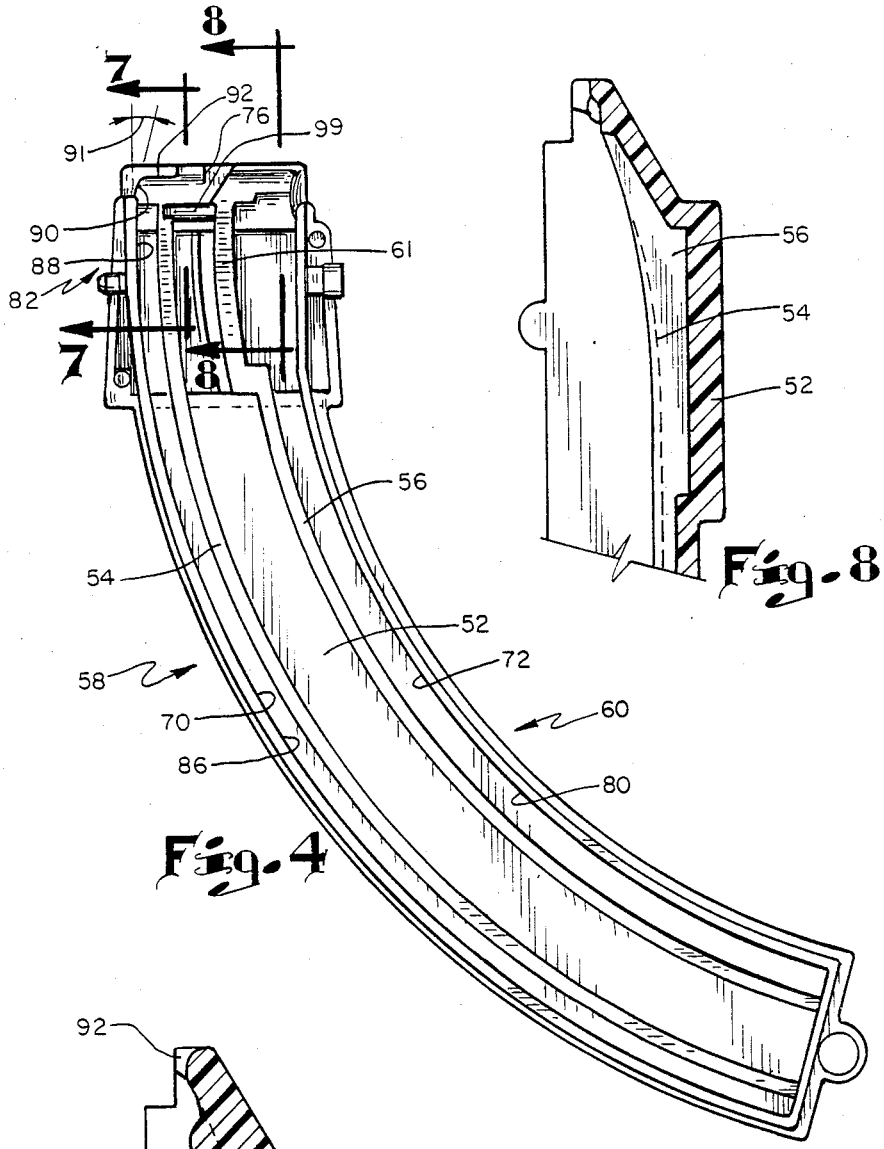
Fig. 4
Fig. 8
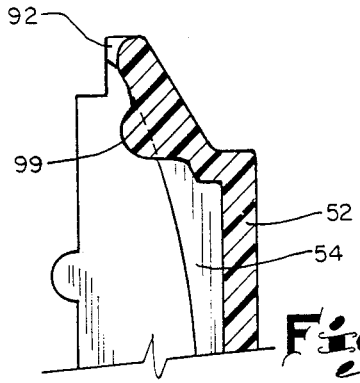
Fig. 7

SIDE-BY-SIDE CARTRIDGE MAGAZINE FOR RIM-FIRE CARTRIDGES

This application is a continuation-in-part of application Ser. No. 805,303 filed Dec. 4, 1985, now U.S. Pat. No. 4,672,670.

FIELD OF THE INVENTION

The present invention relates to a method and apparatus for storing rim-fire cartridges in a side-by-side relationship and in particular to a method and apparatus which maximizes the number of rim-free cartridges which are stored in a magazine of a given size and yet avoids jamming of cartridges as they move through the magazine.

BACKGROUND INFORMATION

Cartridges used with firearms are commonly classified as center-fire or rim-fire, depending on the position of the "primer" in the cartridge. As used herein, "rim-fire" particularly refers to cartridges which are of an enlarged rim configuration, i.e., which have a rim section of a greater diameter than the diameter of the body portion of the cartridge. This type of cartridge has created a number of problems for the design of magazines intended to house such cartridges. In particular, it is difficult to house such cartridges in a space-efficient manner without creating a jamming problem.

It is known that the length of a magazine designed to house a given number of cartridges can be reduced by storing the cartridges in two columns, such as the arrangement depicted in German Pat. No. 90189 issued Mar. 21, 1986 to Clausius. It is further known that the width of two-column magazines can be reduced by offsetting the columns as shown in U.S. Pat. No. 4,112,817, issued Sept. 12, 1978 to Bourlet.

Such two-column arrangements require some means for feeding the cartridges one at a time into the firearm in an orderly fashion. Previous methods have attempted to accomplish this by tapering the interior of the magazine to force two or more columns into a single column, before feeding into the firearm. Such an approach is depicted in U.S. Pat. No. 2,217,848, issued Oct. 15, 1940 to Schillstrom; U.S. Pat. No. 3,345,771, issued Oct. 10, 1967 to Silsby; and U.S. Pat. No. 3,604,142, issued Sept. 14, 1971 to Silsby. These patents do not recognize, or disclose how to solve, certain problems inherent in a tapering approach to a single file feed from a multiple column magazine. In particular, these patents do not disclose how to control the lateral force exerted on the cartridges by the side walls so as to prevent jamming, and yet keep the magazine length to a minimum.

Furthermore, none of these references are directed to rim-fire cartridges and the problems associated therewith. Rim-fire cartridges are particularly difficult to house in a multiple column magazine because the rims must, at least for the uppermost cartridges, be in a relationship so as not to interfere with one another upon extraction of the uppermost cartridge from the magazine. Further, this provision for noninterference of rims must itself be compatible with other provisions for avoiding jamming as the two-column relationship is changed to a single file relationship.

Another method of housing rim-fire cartridges in a strictly single file relationship is shown in U.S. Pat. No. 4,127,954, issued Dec. 5, 1978 to Hausmann. This patent, however, neither recognizes nor discloses how to solve the problems associated with double column storage of rim-fire cartridges and the transition from a double column of cartridges to a single file arrangement of cartridges.

SUMMARY OF THE INVENTION

The present invention relates to a magazine for housing 0.22 caliber rim-fire cartridges in a nested, side-by-side relationship. In order to house a maximum number of cartridges in a predetermined size magazine without jamming of the cartridges, either when inserting or ejecting the cartridges, the magazine incorporates a number of interrelated structural features.

First, throughout the length of the magazine chamber, the cartridges are nested or arranged in a staggered relationship. That is, a portion of each rim of each cartridge lies between one end wall of the magazine and a portion of th rim of a preceding cartridge. The chamber includes a storage zone and a transition zone. In the storage zone, except for the lowermost cartridge in the magazine, each cartridge in the storage zone contacts at least three different cartridges. In the transition zone, each of the cartridges contacts less than three cartridges. To achieve this nesting feature, rails are provided on opposite halves of the magazine. The distance or space between the rails of the two halves is important. In the preferred embodiment of the magazine for use with 0.22 caliber rim-fire cartridges, the distance between the rails in the storage zone for housing the cartridges is about 0.455 inch with a tolerance of only about ±0.015 inch. A second feature relates to the configuration of the storage zone. This area of the magazine is arcuate-shaped. The radius of the interior surface of one end wall of this arcuate section should be about 5.9 inches with a tolerance of only about ±0.25 inch. A third feature found in the present invention is incorporated on the first of two magazine end walls. The first end wall is adjacent to the rims of the cartridges housed in the magazine. Specifically, the first end wall includes three sections, each section characterized by a different shape. The first section is arcuate shaped. The second section of the end wall is connected to the arcuate-shaped portion and comprises one or more substantially straight portions. The third section is connected to the second section of the end wall and is located adjacent to the opened end of the magazine. This third section is a straight line having a predetermined angle, preferably 10°, relative to the second section. Another feature relates to the rail configuration provided on the first of the two magazine halves. In the preferred embodiment, rails on the first half change to a parabolic shape near the opened end of the magazine. The parabolic-shaped rail sections begin in the same upper portion of the magazine that includes the second section of the end wall. This interrelationship between the parabolic-shaped rail sections and the end wall second section is necessary to assure smooth movement of the cartridges and avoid jamming. Still yet another feature included in the present invention is a projection formed on a rail found on the second half of the magazine. The projection is located adjacent to the opened end of the magazine and is used to insure that the cartridges are maintained in the desired, nested relationship. With respect to the rails in both the first half and the second half of the magazine, in one embodiment, the upper portion of the magazine is provided with three rails on the upper portion of the inside of the two side walls of the magazine. The provision of three rails on each side assists in accommodating a number of different cartridge shapes.

In one embodiment of the invention, a lower surface of a lip portion extending partially over the opened end of the magazine is angled downward to assist in maintaining all cartridges in the desired nested relationship and reduce the occurrence of jamming. The downward-angled lip surface assists in properly positioning the top cartridge in a nose-down position and moving the stack of cartridges in the magazine downward as the uppermost cartridge is removed from the magazine. A further feature included in the present invention is the provision of one or more structures designed to prevent any build-up of metal particles, debris, wax or other contaminants on a surface which the cartridges must slide against. The structures include one or more rails adjacent to an end wall of the magazine, one or more baffles to prevent debris from moving downward in the magazine and a valley region near the opened end of the magazine to accommodate any waxy build-up. Lastly, the magazine of the present invention in the preferred embodiment includes a split or dual follower in which one follower is movable relative to the other follower. The split follower contacts the two lowermost cartridges and enables each of the two followers to "walk" relative to the other during at least some of the movement of the split follower as cartridges are moved into and out of the magazine.

In view of the foregoing summary, a number of advantages of the present invention are readily discernible. A cartridge magazine is provided for housing a number of rim-fire cartridges in a side-by-side relationship. The length of the housing is minimized for a given number of cartridges, and yet jamming problems are eliminated. As a result, a magazine is provided that has reliable and safe feeding of rim-fire cartridges into a firearm.

Additional advantages of the present invention will become readily apparent from the following discussion, when taken in conjunction with the accompanying drawings.

BRIEF DESCRIPTION OF THE DRAWINGS

FIG. 4 is an elevational view of the first half of the magazine;

FIG. 7 is a fragmentary, cross-sectional view, taken along lines 7—7 of FIG. 4, showing the parabolic shape of the rail section located relatively adjacent to the first end wall;

FIG. 8 is a fragmentary, cross-sectional view taken along lines 8—8 of FIG. 4, showing the parabolic shape of the rail section located relatively adjacent to the second end wall;

DETAILED DESCRIPTION

Figure 6:
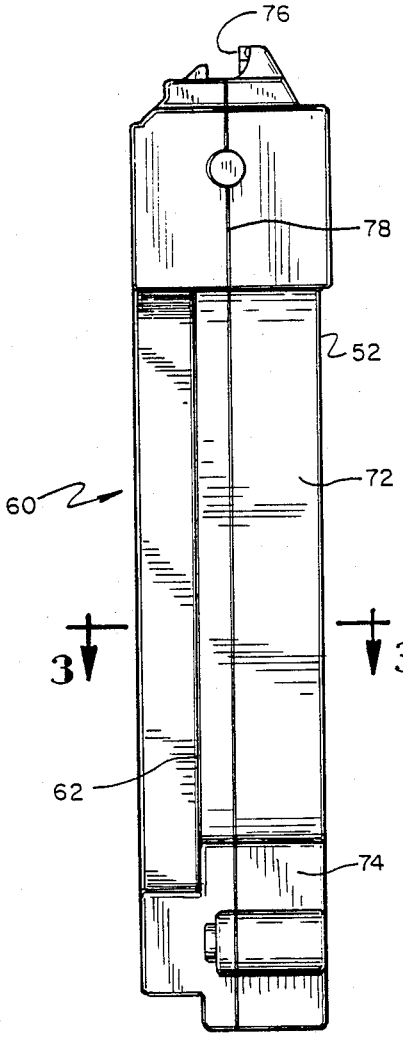
FIG. 6 is an elevational view of the magazine.

The present invention provides an apparatus and method for housing a plurality of 0.22 caliber rim-fire cartridges in a side-by-side relationship so as to optimize packing of the greatest number of cartridges in a storage zone of a magazine while minimizing length and width requirements for the magazine. This configuration minimizes or eliminates jamming of the cartridges as they move through the magazine, and particularly through that region of the magazine where the cartridges are changed from a nested, side-by-side relationship to single file feed of a cartridge through an opening at the top of the magazine. This invention is based on the recognition of two factors that can cause jamming of cartridges in such magazines. The first causative factor is the tendency of the rims of the rim-fire cartridges to "cross over" so that part of the rim of the uppermost cartridge lies behind (i.e., closer to the adjacent end wall) a part of the succeeding cartridge, interfering with removal of the uppermost cartridge from the magazine. The second causative factor is the tendency to develop excessive forces between the cartridge and the magazine wall during transition from a side-by-side relationship to a single file relationship. Such forces inhibit proper sliding movement of the cartridges through the magazine.

The present invention includes a number of features designed to circumvent or eliminate these causative factors. According to this invention, the cartridge rims are maintained in a nested or staggered relationship during the travel of the cartridges through the magazine. The region of the magazine in which the side-by-side relationship of the cartridges is changed to a relationship appropriate for single file feeding of the cartridges into the firearm is designed to assure that the force exerted by a cartridge against the magazine wall or rail is sufficiently low to prevent jamming. In a preferred embodiment, a follower device comprising two followers, each having a certain geometric configuration and being movable with respect to each other, assists in maintaining the proper upward force on the cartridges and thus prevents cross over and also controls cartridge side wall forces. The upper portion of a first end wall is designed in an angled configuration to assure the proper nested or staggered relationship of the cartridge rims when cartridges are loaded into or removed from the magazine.

Before discussing the structural make-up of the magazine, the positional relationship of cartridges within the magazine chamber will first be described. A positional relationship of cartridges in the magazine chamber is provided which minimizes the length and width of the magazine for a given plurality of cartridges but still eliminates or reduces jamming of the cartridges. The cartridges housed in one portion of the magazine, termed the storage zone of the magazine, are in a nested, side-by-side relationship. Preferably, the side-by-side relationship is one in which the centers of three successive cartridge rims lie about at the vertices of an equilateral triangle and in which a portion of the body of each cartridge is contacted by a portion of the rim of the preceding cartridge. For purposes of terminology used in this application, one cartridge "precedes" another if the center of its rim is closer to the open end of the magazine. Creating an equilateral triangle relationship of the centers of successive cartridge rims optimizes the packing of cartridges into the magazine. That is, it is believed that this angular relationship, in a double column cartridge arrangement, accommodates the greatest number of rim-fire cartridges in a magazine of a given longitudinal extent without jamming problems. This result apparently occurs between (1) the force of each cartridge against a side wall in such an angular relationship is insufficient to cause jamming (due to increased friction against or deformation of the side wall) and (2) each cartridge is not allowed sufficient freedom of movement that its rim is able to slip past or "cross over" the rim of another cartridge (loss of nested relationship).

In the case of a magazine having essentially the same longitudinal extent but with a thickness less than that thickness which results in the equilateral triangle relationship, proper movement of the cartridges can be achieved in the magazine chamber. However, such a configuration does not maximize the number of rim-fire cartridges in a magazine having the given longitudinal extent.

In order that the cartridges, which are removed from the housing for insertion into the firearm, be removed in single file fashion through the opened end of the housing, a region of the housing, termed the transition zone, is included in which the positional relationship of the cartridges is changed from a side-by-side relationship. For purposes of this description, the relationship of the cartridges in the transition zone of the housing will be termed "single file," although this term should not be construed to require that any cartridges lie directly in line with one another.

Figure 1:
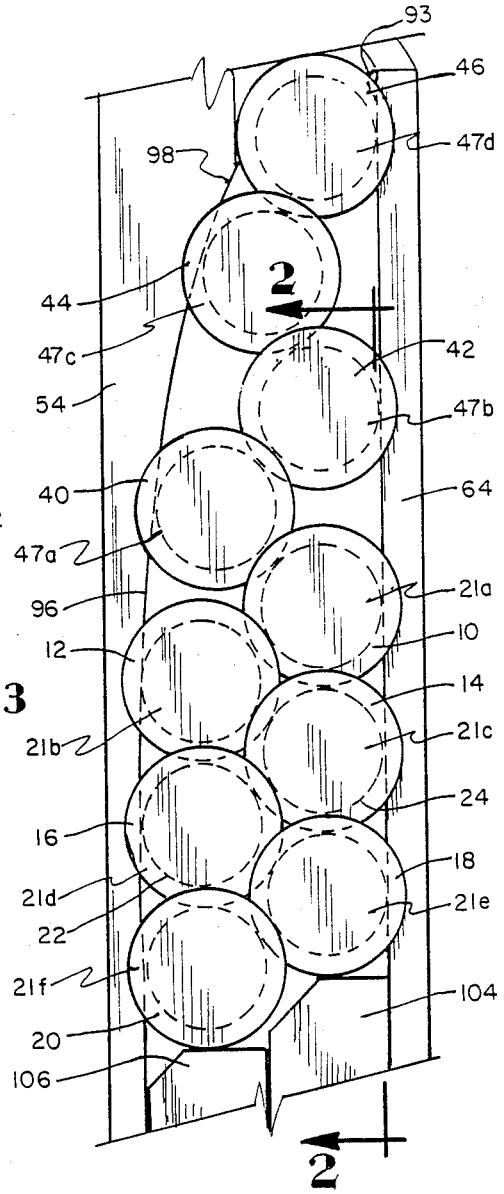
FIG. 1 is an enlarged, fragmentary, sectional view showing the spatial relationship of cartridges in the storage zone and transition zone.

Referring now to FIG. 1, the rims 10, 12, 14, 16, 18, 20 of six cartridges 21*a*, 21*b*, 21*c*, 21*d*, 21*e*, 21*f*, which are in a side-by-side relationship, are shown. The centers of the rims 10, 12, 14 of successive cartridges 21*a*, 21*b*, 21*c* lie at the vertices of an equilateral triangle. Similarly, the centers of the rims 12, 14, 16 of successive cartridges 21*b*, 21*c*, 21*d* lie at the vertices of an equilateral triangle. The body portion 22 of cartridge 21*d*, indicated in FIG. 1 by phanton lines, is contacted by the rim 14 of the preceding cartridge 21*c*. Similarly, the body portion 24 of the cartridge 21*c*, indicated by phantom lines, is contacted by the rim portion 12 of the preceding cartridge 21*b*. It is also noted that in the side-by-side relationship depicted in FIG. 1, the body portion 22 of the cartridge 21*d* is also contacted by the rim portion 12 of a cartridge 21*b* which precedes the preceding cartridge 21*c*, in a manner which can be best seen in FIG. 2.

The rims 40, 42, 44, 46 of four cartridges 47*a*, 47*b*, 47*c*, 47*d*, which are in a "single file" relationship are also shown in FIG. 1. The centers of the rims 40, 42, 44 of successive cartridges 47*a*, 47*b*, 47*d* define a triangle in which the vertex defined by the center of the rim 42 of the middle cartridge 47*b* has an angle greater than 60°. Similarly, the centers of the rims 42, 44, 46 of successive cartridges 47*b*, 47*c*, 47*d* define a triangle in which the vertex defined by the center of the rim 44 of the middle cartridge 47*c* has an angle greater than 60°.

Figure 2:
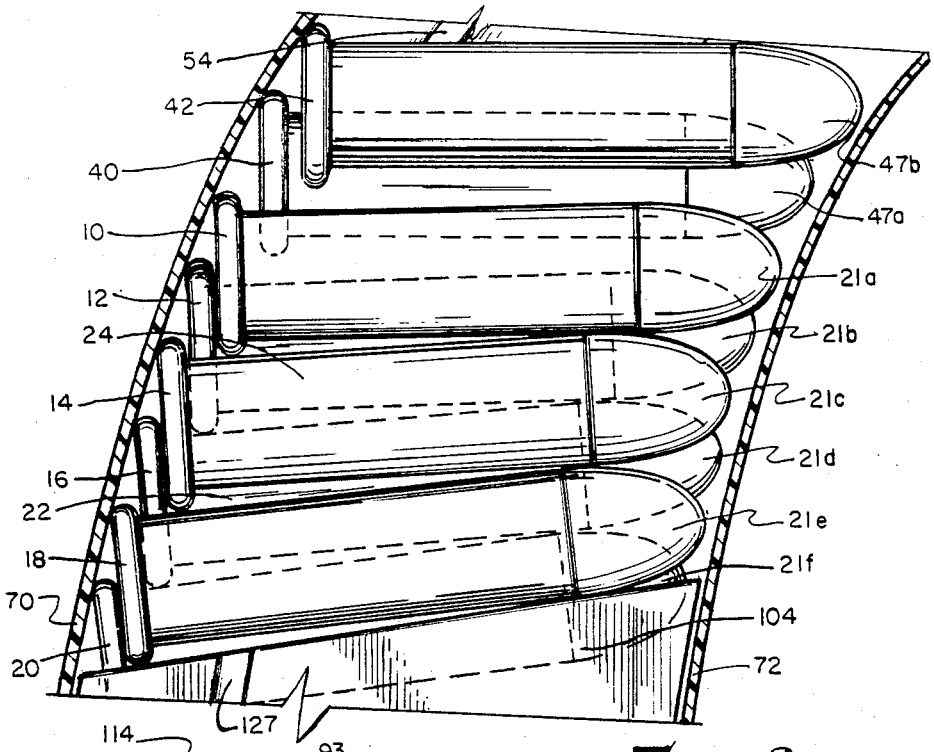
FIG. 2 is an enlarged, fragmentary, cross-sectional view, taken along lines 2—2 of FIG. 1, showing the positional relationship of cartridges in the storage and transition zones.

Another aspect of the positional relationship of the cartridge which is important to this invention is the nested or staggered relationship of the cartridge rims. As used herein, "nested relationship" of cartridge rims means a positional relationship in which a portion of the rim of each cartridge lies between the adjacent end wall of the housing and a portion of the rim of the preceding cartridge. In contrast to the "side-by-side" relationship which is required only in the storage zone of the housing, the nested relationship of the cartridge rims exists for all cartridges in the housing whenever there is more than one cartridge therein. This nested relationship is continuously maintained as cartridges are inserted into the housing or removed from the housing through the opened end of the housing. The nested relationship of the cartridge rims is best seen in FIG. 2. A portion of the rim 20 of the lowermost cartridge 21*f* can be seen to lie between the first end wall 70 and a portion of the rim 18 of the preceding cartridge 21*e*. Similarly, a portion of the rim 18 of cartridge 21*e* lies between the first end wall 70 and a portion of the rim 16 of the next preceding cartridge 21*d*.

Now that the positional relationship of the cartridges in the housing has been described, the manner in which this positional relationship is created and maintained will be discussed.

Figure 3:
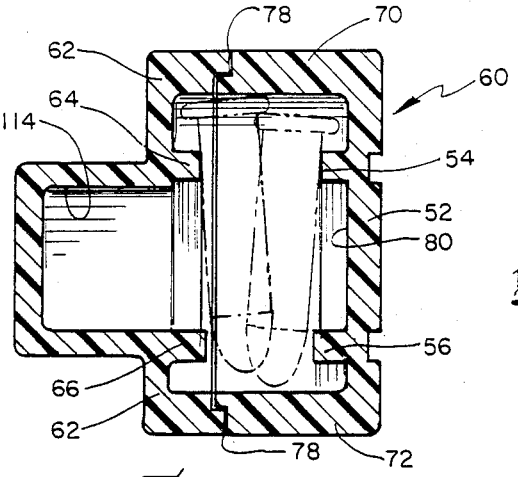
FIG. 3 is a cross-sectional view, taken along lines 3—3 of FIG. 6, showing the distance between the rails formed on connected halves of the magazine.

Maintaining those cartridges in the storage zone in a side-by-side relationship involves a housing having the proper effective thickness and also involves maintaining a force on the lowermost cartridges directed towards the opened end of the housing. As used herein, the "effective thickness" of the housing is the distance between those members which restrain lateral movement (i.e. movement substantially perpendicular to both the cartridge longitudinal axis and the housing longitudinal axis) of the cartridges. Although it is possible to employ the housing side walls as the restraining members, in the preferred embodiment, rails are provided on the side walls to act as the restraining members. Referring now to FIG. 3, a first side wall 52 includes first and second rails 54, 56 in the form of projections extending inward from the first side wall 52. As seen in FIG. 4, the first side wall rails 54, 56 extend into the storage zone 58 of a magazine housing 60. The second rail 56 of the first side wall 52 includes an offset portion 61 that is located adjacent to the opened end of the magazine. Typically, 0.22 caliber cartridges include knurls adjacent to their nose ends. Although it may not be necessary, in a preferred embodiment, to minimize friction between the second rail 56 and the cartridges as the cartridges move in the area of the magazine adjacent the opened end, the rail 56 is offset so that it no longer contacts the knurls of the cartridges. Instead, contact is only made between the smooth body portion of the cartridges and the offset portion 61 of the second rail 56. In another embodiment, the entire second rail 56 is positioned so that none of the second rail 56 contacts the cartridge knurls.

Figure 14:
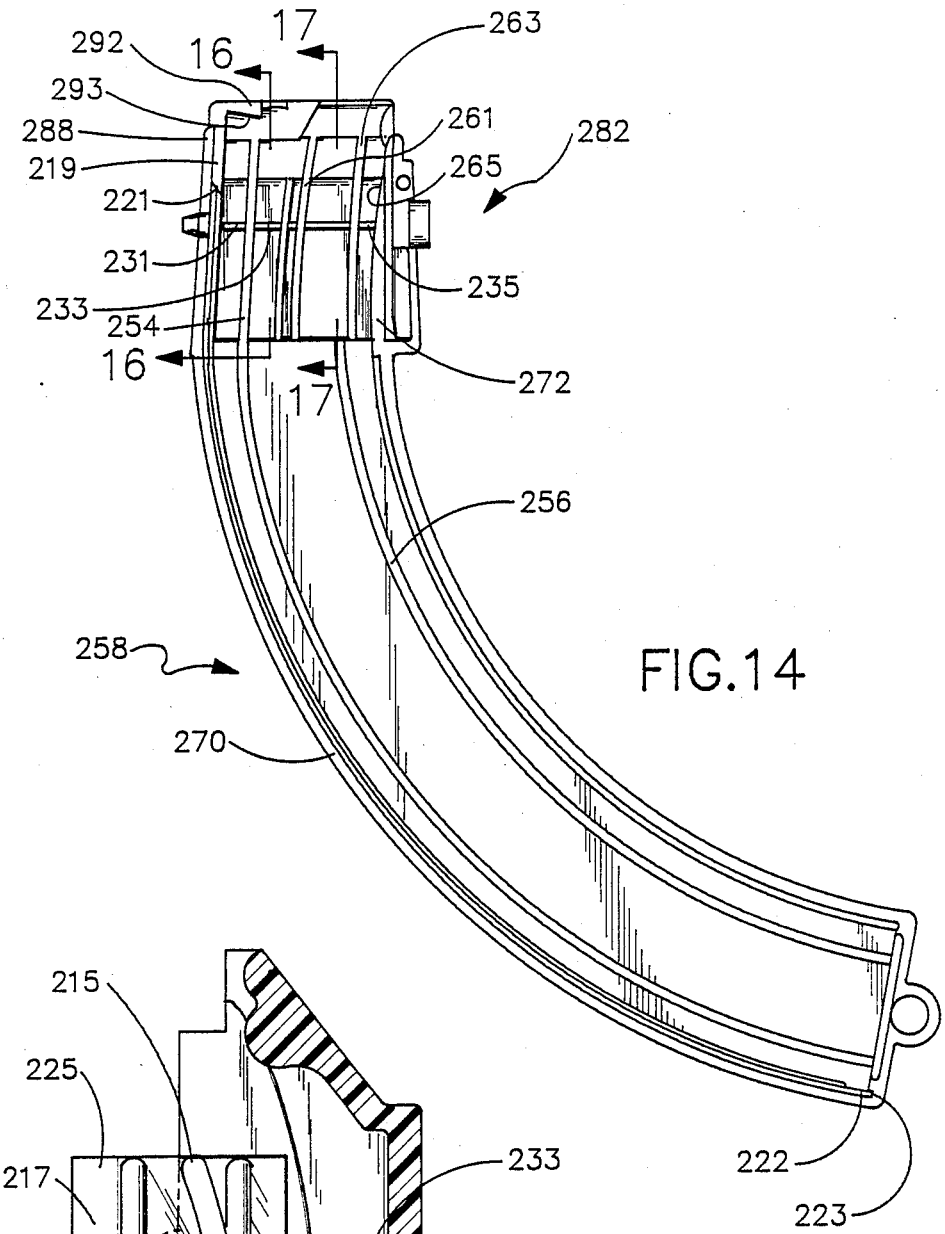
FIG. 14 is an elevational view of the first half of the magazine, showing rails adjacent to the first end wall.

In yet another embodiment, as depicted in FIG. 14, the upper portion 282 of the first half of the magazine is provided with three rails 254, 261, 263. Rail 254 is essentially continuous from the lower portion 258 of the magazine to the upper portion 282 of the magazine. A lower portion second rail 256 is positioned in the lower portion 258 of the magazine at a location similar to the location of the second rail 56 depicted in FIG. 4. However, in the embodiment depicted in FIG. 14, the second and third upper portion rails 261, 263 are both offset from the lower portion second rail 256, i.e. the second and third upper portion rails 261, 263 are positioned on either side of what would be the extension of the lower portion second rail 256. The purpose of providing three upper portion rails 254, 261, 263 in the embodiment depicted in FIG. 14 is to provide proper support for cartridges having a number of different cartridge configurations or shapes. Specifically, the embodiment depicted in FIG. 14 provides support for cartridges which differ in their shape in that some types of cartridges have a somewhat more narrowed nose portion than other types of cartridges. By providing three rails 254, 261, 263 in the upper portion 282 of the magazine, the nose portion of the cartridges which are in the upper portion 282 of the magazine will be supported by one or the other, or both of the second and third upper portion rails 261, 263.

Another useful feature of the embodiment depicted in FIG. 14 is that the upper portion third rail 263 defines a space or valley portion 265 between the third rail 263 and the upper portion of the second end wall 272. The space or valley 265 is useful because it provides a space for holding an accumulation of wax which is typically rubbed or scraped off of the nose portion of the cartridges as they travel through the upper portion 282 of the magazine. Such wax is often present on the nose portion of the cartridges as a result of common bullet manufacturing processes.

Figure 5:
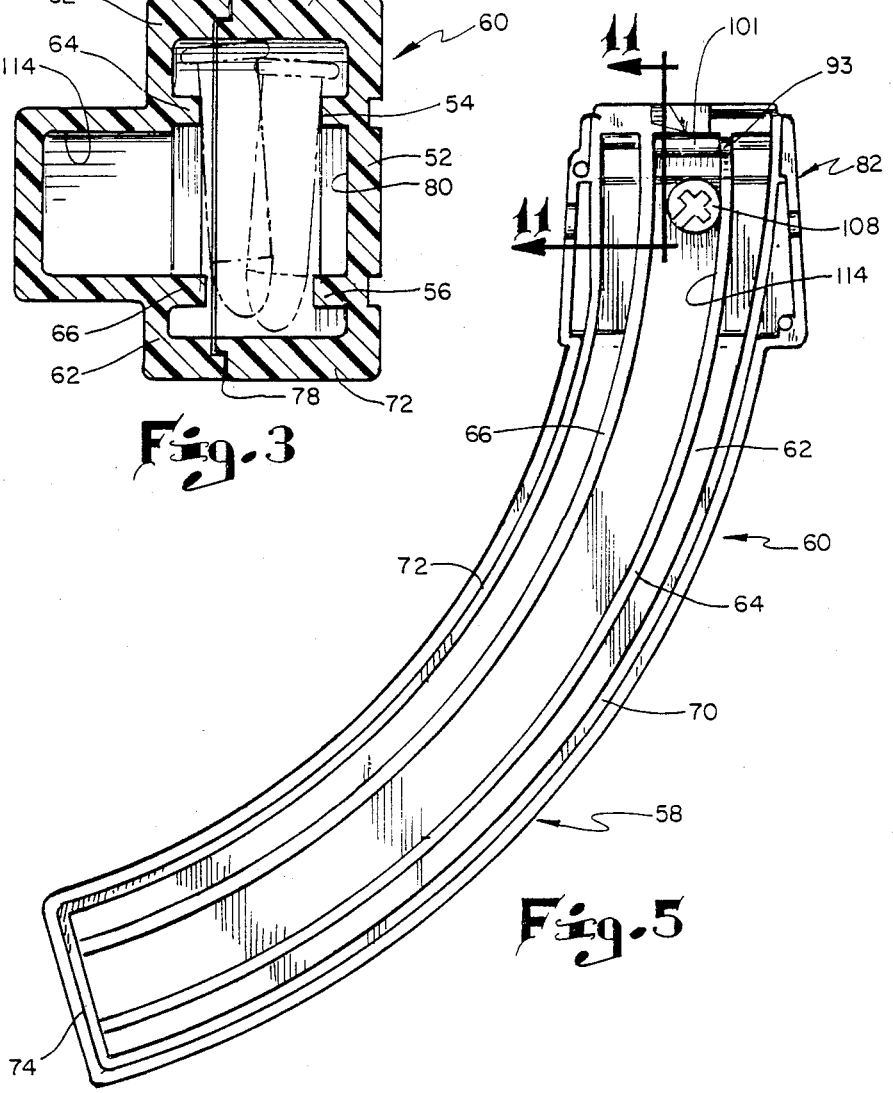
FIG. 5 is an elevational view of the second half of the magazine.

Referring to FIGS. 3 and 5, second side wall 62 includes first and second rails 64, 66, also in the form of elongated projections from the second side wall 62 and which, as seen in FIG. 5, extend into the storage zone 58 of the housing 60. Although the distance may be the same, in the illustrated embodiment, the distance between the first rails 54, 64 of the first and second side walls 52, 62 is greater than the distance between the second rails 56, 66 of the first and second side walls 52, 62. Consequently, the thickness of the housing 60 corresponds to the distance between the aligned second rails 56, 66 of the first and second side walls 52, 62.

To maintain the cartridges which are in the storage zone 58 in the nested, side-by-side relationship, the thickness of the housing 60 is about:

$$D + \frac{\sqrt{3}}{2}(D + \Delta r) \qquad \text{(i)}$$

where D is the diameter of the body portion of the cartridge and $\Delta r$ is the radius of the rim portion of the cartridge minus the radius of the body portion of the cartridge. When the housing 60 is to be used for storing 0.22 caliber cartridges, the thickness of the housing 60 is between about 0.4 inch (1.0 cm) and about 0.5 inch (1.3 cm) and is, preferably, 0.455 inch with a tolerance of only about $\pm 0.015$ inch.

In order to maintain the cartridges in the side-by-side relationship, a follower device is included to produce a force urging the cartridges towards the opened end of the housing 60. Briefly, the follower device can be used to overcome the constraints presented by the rails to the movement of the cartridge rims along the body of the magazine. There are other considerations relating to the amount of force needed to be provided by the follower device and these are discussed more fully below. For the present purposes it suffices to note that the follower device contacts both the lowermost cartridge **21*f* and the preceding cartridge 21*e***, applying a force directly to these two cartridges.

The manner in which the cartridge rims are maintained in a nested relationship involves insuring that such a nested relationship is established automatically when rim-fire cartridges are inserted into the housing 60 and also involves constantly maintaining contact between the body portion of any particular cartridge and a portion of the rim of the preceding cartridge.

The manner in which the nested relationship of the rims is established and preserved upon insertion or removal of cartridges through the opened end of the housing 60 is related to certain structural features of the housing 60. As seen in FIG. 6, the housing 60 comprises the first side wall 52 and the second side wall 62, a first end wall 70, a second end wall 72, a bottom end 74 and an opened end 76. In the embodiment shown in FIG. 6, the housing 60 is formed by attaching two mating halves **77*a*, 77*b* along a seam line 78. As seen in FIG. 3, when the halves are mated along the seam line 78, preferably by such methods as ultrasonic welding or attachment by an adhesive, the first and second end walls 70, 72, first and second side walls 52, 62, form a magazine having a chamber 80**.

Figure 16:
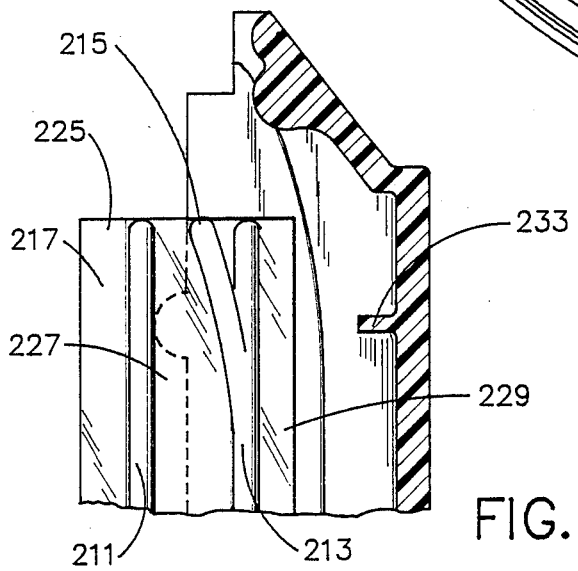
FIG. 16 is a fragmentary, cross-sectional view taken along line 16—16 of FIG. 14 showing the plate having rails adjacent the first end wall and a debris baffle.
Figure 17:
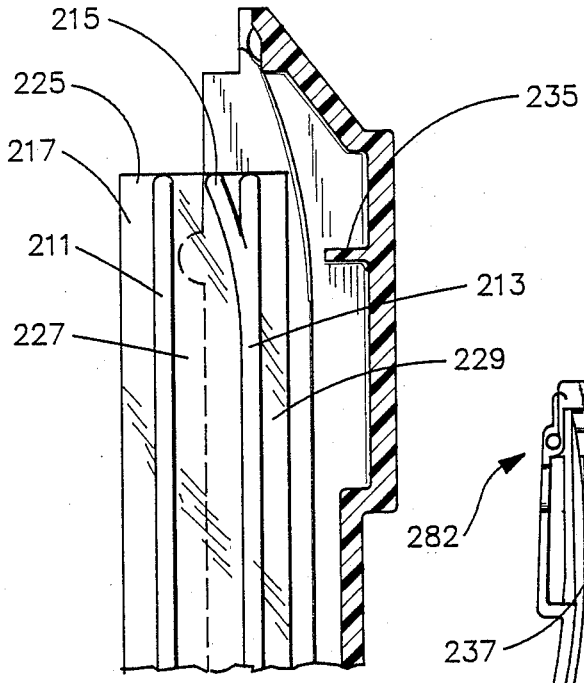
FIG. 17 is a fragmentary, cross-sectional view taken along line 17—17 of FIG. 14 showing the plate having rails adjacent the first end wall and a debris baffle.
Figure 19:
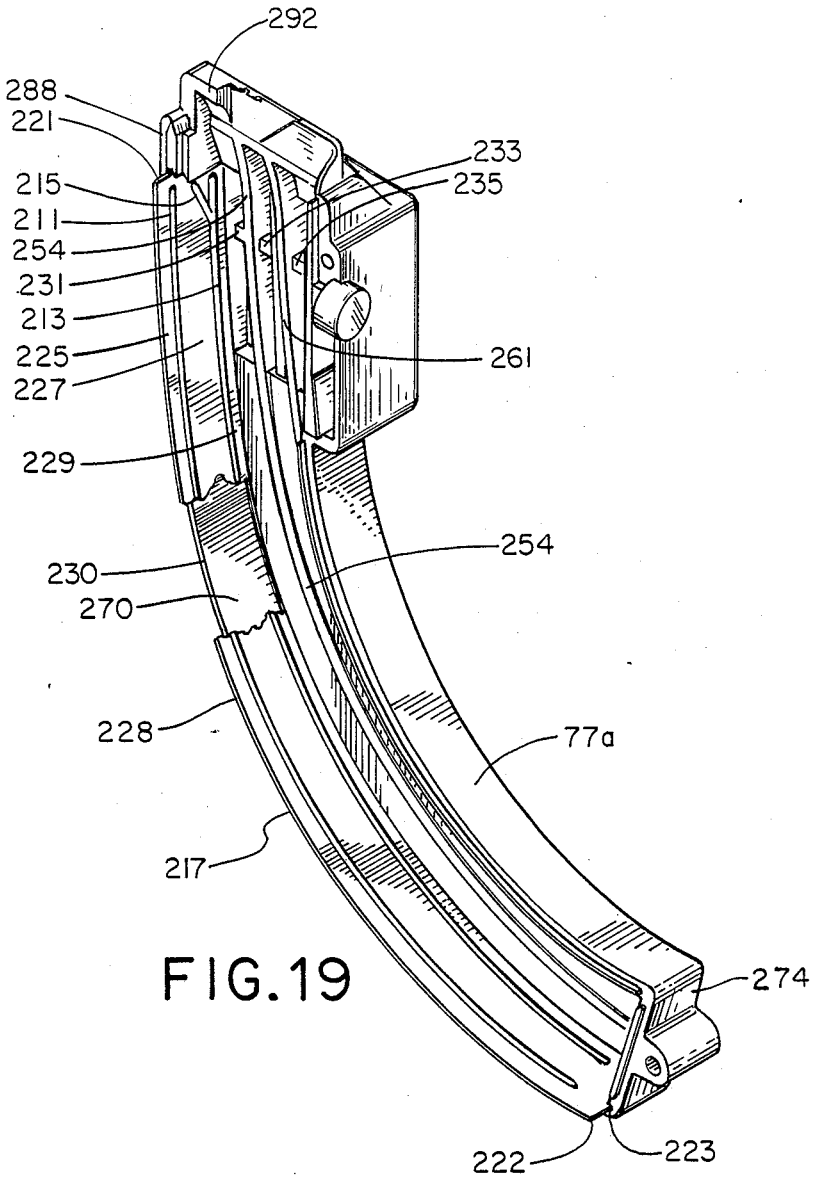
FIG. 19 is a perspective view of the interior of the first mating half of the housing with the plate bearing the end wall rails partly cut away.

Another embodiment of this invention includes providing one or more rails, preferably two rails 211, 213 along the first end wall 270, as depicted in FIGS. 12–17. As best seen in FIG. 19, the rails extend substantially the length of the first end wall 270 and project preferably about 0.065 inch inward from the end wall 270. The rails 211, 213 are substantially parallel throughout the lower portion of the magazine 258 and are preferably spaced approximately 0.245 inch apart. As best seen in FIG. 16, an upper portion 215 of the second rail 213 is curved inward or towards the first rail 211 to assist in preventing jamming.

Figure 13:
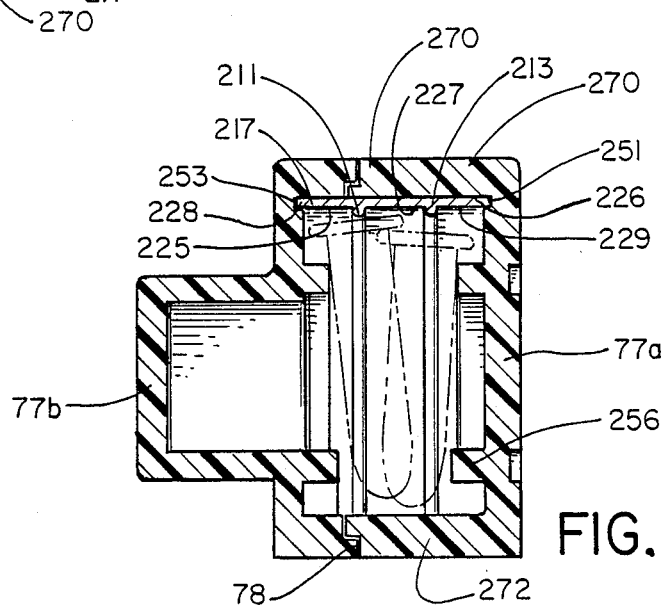
FIG. 13 is a cross-sectional, view similar to that of FIG. 3 but of another embodiment, showing a plate having rails positioned adjacent to the first end wall.

Although the end wall rails 211, 213 can be formed by any of a number of methods, in order to assist in providing all parts of the magazine by an injection molding method, it is preferred that the rails 211, 213 be formed by injection molding an insert or plate 217 bearing the rails 211, 213 projecting preferably about 0.2 inch from one surface of the plate 217. The plate 217 and rails 211, 213 are positioned against the first end wall 270 as described below. To assist in placing and holding the plate 217 in position, as depicted in FIG. 14, the upper portion 288 of the first end wall 270 is provided with a dovetail or angled shape 219. The upper end of the plate 217 and end wall rails 211, 213 are also provided with a complimentary angled end 221. The lower end 222 of the plate 217 fits into a slot 223 formed in the bottom end 274. To further assist in positioning and holding the plate 217 in the desired position, first and second grooves 251, 253 are provided adjacent to the first end wall 270 as depicted in FIG. 13, to receive the first and second edges 226, 228, respectively, of the plate 217.

The purpose of providing the rails 211, 213 is to reduce or eliminate problems associated with the occurrence and build-up of debris such as metal particles or plastic particles which commonly occur in the interior of a cartridge magazine during use. These particles or debris are typically the result of abrasion of cartridges as they move through the magazine. If no device is provided for accommodating this debris, the debris will typically build up so that the cartridges, as they move through the magazine, are hindered by the abrasive quality of the debris or particles. By providing the rails 211, 213, against which the rims of the cartridges slide, the debris or particles are, by this sliding movement, pushed into the valleys or spaces 225, 227, 229 defined by these ridges 211, 213. As the particles or debris are pushed into the valleys or spaces 225, 227, 229, the ridges 211, 213 are left relatively clear so that the rims can move or slide against the ridges 211, 213 substantially without interference or hindrance by the accumulation of particles or debris.

Figure 15:
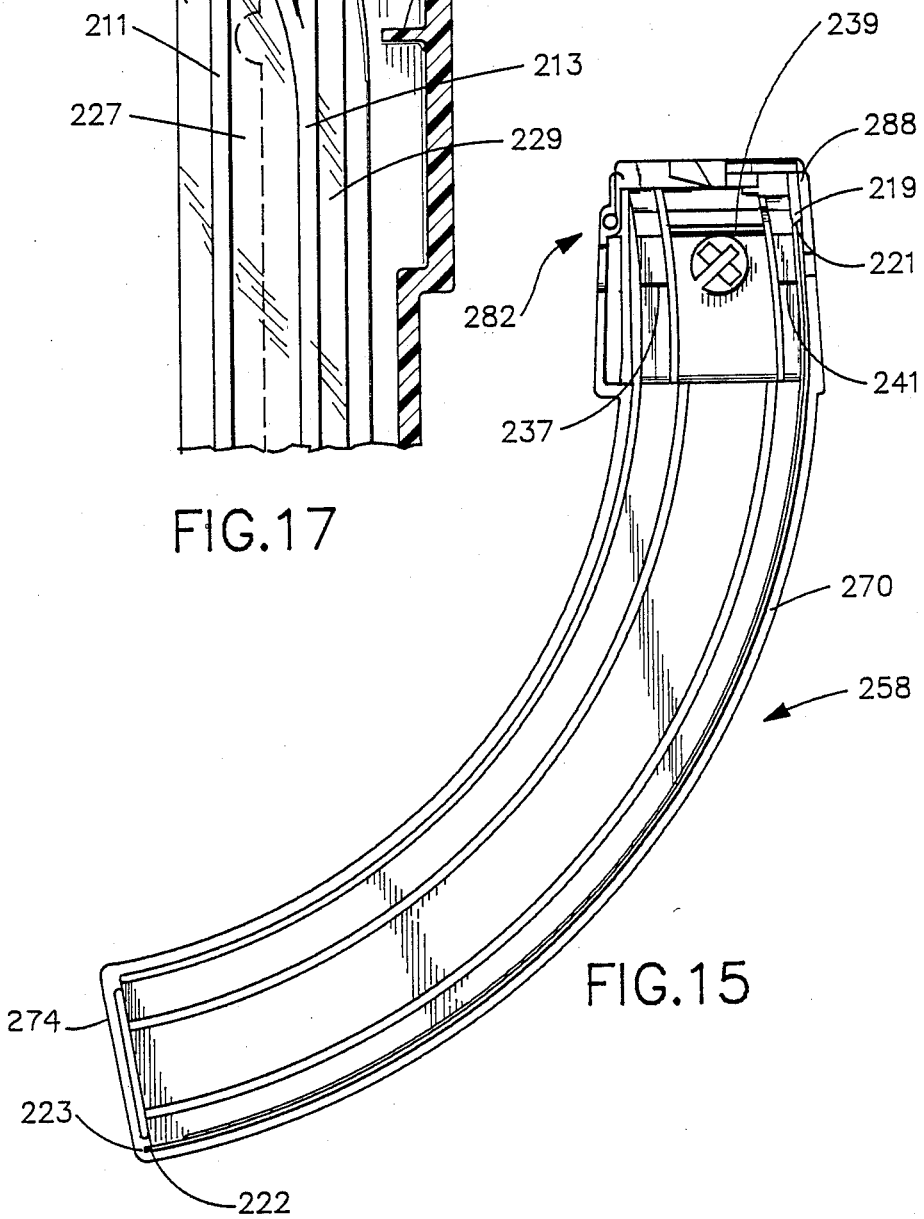
FIG. 15 is an elevational view of the second half of the magazine showing rails adjacent to the first end wall.

In order to further assist in preventing the accumulation of or interference by particles or debris, baffles are provided in the magazine. As shown in FIG. 14, three baffles 231, 233, 235 are provided in the upper portion 282 of the first half of the magazine. As depicted in FIG. 15, three baffles 237, 239, 241 are provided in the upper portion of the second half of the magazine. The baffles 231, 233, 235, 237, 239, 241 are all in the form of plates or shelves projecting from the side walls inwardly into the upper portion 282 of the magazine. The purpose of the baffles 231, 233, 235, 237, 239, 241 is to assist in minimizing the downward fall or migration of particles or debris which often occur in the upper portion of the magazine.

As best shown in FIG. 4, the chamber 80 includes the storage zone 58 and a transition zone 82. The first end wall 70 includes a first section 86 which is substantially arcuate-shaped, a second section 88 which is substantially straight, and a third section 90. The third section 90 is also substantially straight but is formed so as to define a predetermined angle 91 relative to the second section 88 of the inner surface of the first end wall 70. This predetermined angle 91 is at least 5° and is preferably about 10°. In the preferred embodiment, the arcuate section 86 is defined by a radius of about 6.24 inches with a tolerance of only about ±0.25 inch.

The purpose of making the third section 90 angled with respect to the second section 88 is to assure that as cartridges are inserted into the chamber 80 through the opened end 76 of the housing 60, the rim of the uppermost (i.e. closest to the opened end 76) cartridge will be somewhat pushed forward (i.e. in a direction towards the second end wall 72) by contact with the third section 90 of the first end wall 70. Because of this forward position, the rim of a cartridge which is inserted into the uppermost position in the chamber 80 will contact the body portion of the succeeding (i.e. the next lower) cartridge, which will be forced backward against the second section 88 of the first end wall 70. Thus, the rim of the uppermost cartridge is prevented from riding on the rim of the succeeding cartridge or from passing over the rim of the succeeding cartridge to "cross over" and thus lie behind (i.e. closer to the first end wall 70) the rim of the succeeding cartridge. In this manner, each cartridge which is inserted into the chamber 80 assumes a position such that the rim of the succeeding cartridge lies between the rim of the uppermost cartridge and the first end wall 70 thus placing each inserted cartridge in the desired nested relationship.

The angled relationship of the third section 90 performs a similar function when cartridges are removed from the housing 60. Since the third section 90 forces the uppermost cartridge slightly forward, the rim of the uppermost cartridge is prevented from "crossing over" the rim of the succeeding cartridge as cartridges are removed from the housing 60.

Another aspect of the invention which assists in maintaining the desired nesting relationship is seen in the embodiment depicted in FIG. 14. In this embodiment, a lip 292 is provided with a downward sloping or angled lower surface 293. By "angled" it is meant that the imaginary plane which the lower surface 293 substantially defines intersects a line lying along the longitudinal axis of the uppermost cartridge. The angled surface 293 provides two advantages. First, the angled surface 293 pushes against the uppermost cartridge such that the nose portion of the uppermost cartridge is positioned in a nose-down configuration, i.e. a configuration such that the nose portion is pointed somewhat more away from the opened end of the magazine than would be the case if the surface 293 were not angled downward. Further, as the uppermost cartridge is removed through the opened end of the magazine by pushing the uppermost cartridge forward, the uppermost cartridge will move somewhat downward and thus assist in moving the stack of cartridges downward as the uppermost bullet is removed from the magazine. The downward movement of the remaining cartridges in the magazine and the nose-down position of the uppermost cartridge assist in avoiding jamming of the cartridges as they move through the magazine.

Figure 9:
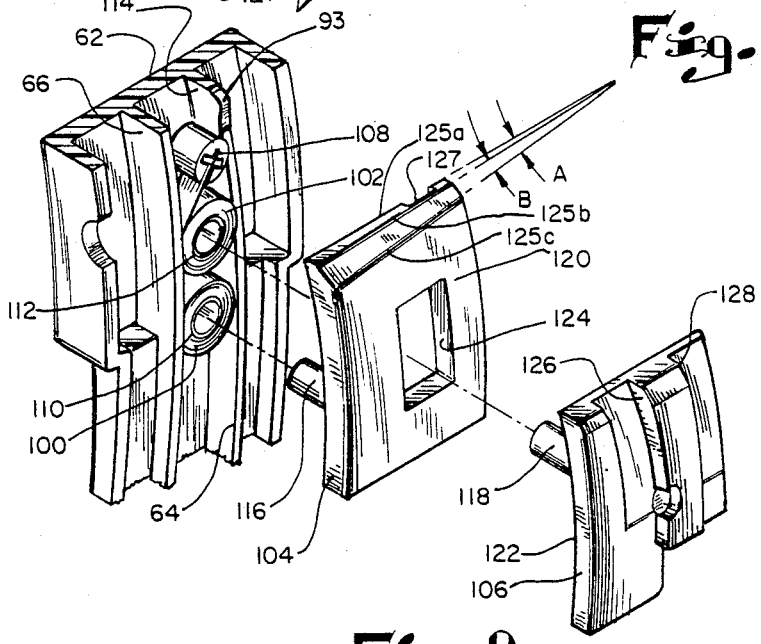
FIG. 9 is an exploded view of the split follower showing its relation to the second half of the magazine.

To further establish the desired nesting relationship, a projection 93 is provided on the first rail 64 of the second side wall 62. The projection 93, as seen in FIGS. 1, 5 and 9, is located adjacent to the opened end of the magazine. The projection 93 contacts the body portion of a cartridge and causes it to move such that it is unable to stack directly on top of an adjacent cartridge thereby insuring the nested relationship.

Proper functioning of the second and third sections 88 and 90 is assisted using a follower device that exerts a force on the cartridges which tends to urge the cartridges towards the opened end 76 of the housing 60 so as to assure that the rim of the uppermost cartridge is forced upward to bear against the third section 90 and does not slip or fall downwards to bear against the second section 88.

The follower device also performs a second function useful in maintaining the cartridge rims in a nested relationship. This function relates to the fact that if cartridges, which are in a nested relationship, are maintained in such a way that the body portion of any given cartridge is continuously in contact with the rim of the preceding cartridge, there can be no cross over of the rims, such as will result in jamming. This result occurs since such cross over would require the event, improbable in the configuration of the apparatus of the present invention, that the body portion of a given cartridge come out of contact with the rim of a preceding cartridge as the rim of a preceding cartridge rides upward and over the rim of the given cartridge.

The manner in which the rim-fire cartridges are maintained in a position so that each cartridge is continuously contacted by a portion of the rim of the preceding cartridge involves maintaining a force on all cartridges directed upwards. The follower device acts to compress the plurality of cartridges between the follower and the opened end 76 of the housing 60. The upward force from the follower device does not eject the uppermost cartridge through the opened end 76 of the housing 60 because the housing 60 includes a mechanism for engaging the uppermost cartridge. The precise configuration of the engaging mechanism will depend upon the intended use of the housing 60 and, particularly, the requirements of the firearm with which the housing 60 can be used. In the embodiments depiected in FIGS. 1–11, the housing 60 is shown in a configuration intended to house 0.22 caliber rim-fire cartridges and which is intended to be used with a Ruger 10/22 or 77/22 style of firearm. The engaging mechanism in this embodiment comprises a lip member 92. Thus, the cartridges in the chamber 80 are maintained in a compressed condition between lip 92 and the follower device.

In order for the magazine to function properly in cooperation with a firearm to accomplish feeding of rim-fire cartridges stored in the magazine into the firearm for firing of the cartridges, it is necessary that the rim-fire cartridges be extracted from the opened end 76 of the housing 60 one at a time. It is for this reason that cartridges in the area close to the opened end 76 of the housing 60 are in a single file configuration as opposed to a side-by-side positional configuration, as discussed above and as depicted in FIG. 1. When the cartridges in the upper portion of the housing 60 are in a single file configuration, cartridges may be fed from the housing 60 into a firearm in an orderly fashion and without jamming provided the cartridge rims are maintained in a nested position as described above. In order to accomplish feeding of cartridges into a firearm, a force must be maintained on the cartridges in a direction towards the opened end 76 of the housing 60. This force is maintained by the follower device. In order to achieve proper feeding of the cartridges, the upward force must be sufficient to move the plurality of cartridges upward through the chamber 80, as described more fully below, and must be sufficient to achieve an upward acceleration of the cartridges sufficient to accommodate the requirements of the firearm, such as a Ruger 10/22 or 77/22.

In order that a single file relationship be maintained in the upper region of the housing as cartridges are removed from the housing, it is necessary to change the positional relationship of individual cartridges from a side-by-side relationship to a single file relationship as the cartridges move upward through the chamber 80. The manner in which this change of positional relationship is accomplished involves producing a force on the cartridges tending to urge at least some cartridges in a lateral direction (i.e. a direction substantially perpendicular to both the longitudinal axis of the cartridge and the longitudinal arcuate axis of the housing 60). This force is produced by a thickness which is progressively reduced in the transition zone 82 of the housing 60. As previously noted, the thickness of the housing 60 is defined by the distance between the second rails 56, 66. As shown in FIG. 7, the upper portion of the first wall first rail 54, which is in the transition zone 58, slopes inward (i.e. towards side wall 62). Thus, as shown in FIG. 1, as a cartridge moves from the position occupied by cartridge **21*b* to the position ocupied by cartridge 47*a*, the narrowing of the chamber thickness resulting from the inward sloping of the first wall first rail 54 creates a force on the cartridge thus moved which has a component directed towards the second side wall 62 and results in lateral movement of the cartridge as it moves upward through the chamber 80. This lateral movement of the cartridge 47*a* is accommodated by separation of cartridges 21*a*, 47*b* so that cartridges 21*a*, 47*b* are no longer in contact with each other as they were when both cartridges 21*a*, 47*b*** were in the storage zone. In this manner, changing from a side-by-side positional relationship to a single file relationship of the cartridges is accomplished.

It has been found that careful attention must be given to the configuration of the inward sloping portion of the first side wall first rail 54 in order to avoid jamming. The manner in which the present invention avoids jamming is best understood after consideration of the forces which act on an individual cartridge as it moves through the chamber 80 and undergoes changing from a side-by-side positional relationship to a rotating, single file positional relationship.

The forces acting on a cartridge will be discussed in relation to cartridge **21*b* as it moves upward to occupy the position indicated in FIG. 1 by cartridge 47*a***, although similar force analysis will apply to other cartridges as they change from a side-by-side positional relationship to a single file positional relationship.

Cartridge **21*b* is acted upon by a number of forces as it is urged upwards through the chamber 80. Cartridge 21*c*, which is being indirectly urged upward by the follower device, exerts an upward force on cartridge 21*b*. Cartridge 21*c* exerts a force on cartridge 21*b* directed along the line from the center of cartridge 21*c* to the center of cartridge 21*b*. Similarly, cartridge 21*a* exerts a force on cartridge 21*b* along the line from the center of cartridge 21*a* towards the center of cartridge 21*b*. As discussed above, when cartridges 21*a*, 21*b*, 21*c* are in a side-by-side relationship, the centers of the rims 10, 12, 14 of these cartridges define the vertices of an equilateral triangle so that when the forces acting from the direction of cartridges 21*a*, 21*c* towards cartridge 21*b* are vector-summed, the resulting force has a component directed towards the point of contact of cartridge 21*b* with the first side wall first rail 54, the magnitude of which is related to the cosine of the vertex, defined by the center of cartridge 21*b*, of the equilateral triangle defined by the centers of cartridges 21*a*, 21*b*, 21*c*. This force component directed towards the first side wall first rail 54 is balanced by a force exerted by the first side wall first rail 54 towards the center of cartridge 21*b*. As cartridges are removed from the opened end 76 of the housing, cartridges 21*a*, 21*b*, 21*c* advance upward until cartridge 21*b* reaches a point where the thickness of the housing begins to narrow. This narrowing creates an increase in the force directed from first side wall first rail 54 towards the center of cartridge 21*b*. The amount of increase in force is related to how steeply first side wall first rail 54** slopes inward.

As used herein, the slope of the first side wall first rail 54 is the incremental change in the lateral direction of the first side wall first rail 54 (i.e., the change in thickness of the first rail 54) divided by a given, incremental change in the vertical direction (i.e. in a direction along the longitudinal housing axis) of the first side wall first rail 54. In analytic terms, in a coordinate system where the X axis is directed in the lateral direction, as already defined, and the Y axis is directed in the vertical direction, the slope of the first side wall first rail 54 is dx/dy.

When the slope of the first side wall first rail 54 is too great, an excessive force component is created in the direction from the first side wall first rail towards the center of cartridge 21*b* as it moves through the chamber 80. This can produce jamming. Such jamming results from two causes. First, since the degree of friction between first side wall first rail 54 and cartridge 21*b* is related to the amount of force between first side wall first rail 54 and cartridge 21*b*, an increase in the force results in an increase in friction. When this friction increases to the point where it prevents cartridge 21*b* from freely sliding along first side wall first rail 54 so as to move upward through the chamber 80, jamming results.

A second cause of jamming relates to the thickness of the housing 60. When the thickness of the housing 60 is sufficiently altered, the cartridges are no longer in the desired, nested relationship. As a result, jamming can occur due to cross over of cartridge rims or excessive lateral forces.

The configuration of the present invention also controls the lateral force exerted on the cartridge to maintain such force at a level sufficiently low that jamming is eliminated. The manner in which the magnitude of the lateral force is controlled involves the transition zone 82 in which the slope of the first side wall first rail 54 is configured so as to maintain the lateral force below a desired level.

In order to understand the configuration of the first side wall first rail 54, which will produce the desired control of lateral force, it is necessary to once again consider the forces acting on an individual cartridge as the cartridge enters the region of narrowed thickness and moves further towards the opened end 76 of the housing 60. As noted above, as cartridge 21*b* first enters the region of reduced thickness, it is exposed to a force from the first side wall first rail 54 which is directed towards the second side wall 62 and it also is subjected to the sum of the forces from cartridges 21*a*, 21*c* which tends to push cartridge 12 towards the first side wall first rail 54. This second force, as noted, is related to the cosine of the angle of the vertex at the center of the rim 12 of cartridge 21*b* of the triangle defined by the centers of the rims of cartridges 21*a*, 21*b*, 21*c*, i.e., the cosine of 60°. As cartridge 21*b* moves further up into the region of reduced thickness, the angle at said vertex at the center of the rim 12 of cartridge 21*b* becomes greater than 60° because the positional relationship of the cartridges is changing from a side-by-side relationship to a single file relationship, as already discussed. Thus, as cartridge 21*b* moves upward through the region of reduced thickness, the force which results from cartridges 21*a*, 21*c* decreases because the angle of the vertex at the center of cartridge 21*b* increases beyond 60° causing the cosine of that angle to decrease. Since the force tending to press cartridge 21*b* against first side wall first rail 54 is largest when cartridge 21*b* first enters the region of narrowed thickness, it is at this point that the force created from the first side wall first rail 54 must be most stringently controlled, i.e., it is at this point that the slope of the first side wall first rail 54 must be smallest. As cartridge 21*b* moves further through the region of narrowed thickness and thus is less subject to the force tending to press it against the first side wall first rail 54, it is possible to increase the slope of the first side wall first rail 54, and thus increase the force acting from the first side wall first rail 54 against cartridge 21*b* without creating an excessive force, i.e., a force which is sufficiently high that jamming results.

The present invention then includes a first side wall first rail 54 which, in the transition zone 82, i.e., the region of reduced thickness, always has a slope configured to control the lateral force on a cartridge so as to prevent jamming. The slope in the upper portion of the transition zone 82 can be greater than the maximum allowable slope for the lower portion of the transition zone 82. Thus, the transition zone can be subdivided into a first portion 96 in which the first side wall first rail 54 has a first slope and a second portion 98 in which the first side wall first rail 54 has a second slope which can be greater than the first slope. The slope of the first side wall first rail 54 in the second portion 98 may be constant to produce a straight or linear surface in the second portion 98, or the slope of the first side wall first rail 54 in the second portion 98 may vary. In the embodiments depicted in FIGS. 1–11, the slope in the second portion 98 continuously varies in such a manner as to produce a first side wall first rail 54 having a parabolic shape in the second portion 98. However, it should be understood that configurations other than parabolic could be employed, such as ellipsoid.

From the above description with respect to the parabolic-shaped first side wall first rail 54 in the second portion 98, it is readily understood that cartridges, in moving from the storage zone 58 to and through the transition zone 82, experience increasing dx/dy rail increments. For example, greater X movement for a given Y increment occurs for a cartridge moving from the position occupied by cartridge 21*b* to the position occupied by cartridge 47*a* than is experienced by a cartridge moving from the position occupied by cartridge 47*a* to the position occupied by cartridge 47*c*.

The transition zone 82 also includes, in the preferred embodiment, a pair of restraining members 99, 101, as illustrated in FIGS. 4, 5, 7 and 11. As can be seen from the figures, the restraining member 99 is connected to or integral with the inner surface of the first side wall 52 and is located between first and second rails 54, 56. Similarly, restraining member 101 is connected to or integral with the inner surface of the second side wall 62 and is located between first and second rails 64, 66. Each of the two restraining members 99, 101 extends into the chamber 80 and together act to prevent unwanted insertion of a cartridge rim into the chamber 80. In particular, in loading or inserting a cartridge into the magazine of the present invention, it might be desirable to position the cartridge parallel to the magazine at its opened end and then insert the cartridge into the magazine with the rim of the cartridge being the leading end. In such a case, the cartridge rim could be inserted too far into the chamber by the user creating a disruption of the nested relationship of the other cartridges in the magazine and thereby cause jamming. To overcome this potential problem, the two restraining members 99, 101 are located to prevent the cartridge rim from extending too far into the chamber 80. That is, the distance or space between the two restraining members 99, 101 is insufficient to permit the passage of a cartridge rim, but such a space is of a size to permit the passage of the body portion and the nose end of the cartridge.

In the preferred embodiment, the first side wall second rail 56 also slopes inwardly in the transition zone 82, having substantially the same contour as that of first side wall first rail 54. When cartridge 21*b* has entered the transition zone 82, the amount of force directed from cartridges 21*a*, 21*c* towards cartridge 21*b* is related to the amount of force exerted upwards on the cartridges by the follower device. Thus, in order to maintain proper control on the force of the first side wall first rail 54 against the cartridge 21*b*, some consideration must be given to the magnitude of the force which is created by the biasing of the follower device. Certain types of biasing device, in particular, compression springs are subject to a large variation in the force produced by the spring as the spring changes from a fully compressed to a relaxed configuration. Thus, if this type of spring is used, it is necessary to design the slope in the first portion of the transition zone to accommodate the large force produced by a compression spring-biased follower when the housing is fully loaded and the spring fully stressed. Since, as noted above, one of the purposes of this invention is to allow storage of the maximum number of cartridges in the minimum length housing 60, it is desired that the first portion 96 of the transition zone 82 have as great a slope as can be tolerated since as the slope decreases, the overall length of the housing 60 which will accommodate a given number of cartridges must increase. Therefore, it is preferred to employ a biasing device for the follower device which is subject to little if any variation in the degree of force produced as the follower device moves upward through the chamber 80. In this way, the maximum force produced by the spring can be reduced, allowing the slope of the first portion 96 of the transition zone 82 to be increased and the length of the first portion 96 to be reduced, relative to magazines using other types of biasing devices.

Such a preferred biasing device is a constant force spring. One such constant force spring configuration is depicted in FIG. 9. This biasing device is in the form of two spiral springs 100 and 102. Two springs are provided because the follower device is configured in the form of a dual or split follower for a purpose to be described below. For the present purpose, it suffices to state that the first spring 100 acts to bias a first follower 104 and a second spring 102 acts to bias a second follower 106 of the split follower. One end of each of the springs 100 and 102 is attached to an anchor 108. The remaining portions of the springs 100 and 102 are wound, in substantially relaxed condition, around first and second hubs 110, 112 respectively. The springs 100, 102, anchor 108 and hubs 110, 112 are disposed in a side wall groove 114.

A post 116 is attached to the first follower 104. A post 118 is attached to the second follower 106. The first follower post 116 acts as an axle for the first hub 110 and the second follower post 118 acts as an axle for the second hub 112 when the first follower 104 and the second follower 106 are assembled within the housing 60. When cartridges are inserted through the opened end 76 of housing 60, thus forcing downwards the first follower 104 and second follower 106, the first and second springs 100 and 102 are forced to unwind into a tensioned position, thus creating a force on the first follower 104 and the second follower 106 tending to urge the followers toward the open end 76 of the housing.

As best seen in FIG. 1, the spatial relationship of cartridges in the storage zone 58 of the housing 60 is such that the vertical distance between the lowermost cartridge 21*f* and the previous cartridge 21*e* is a constant value as long as cartridges 21*e*, 21*f* are within the storage zone. However, as cartridges are removed from the housing 60 and cartridges 21*e*, 21*f* enter the transition zone, cartridges 21*e*, 21*f* change from a side-by-side relationship to a single file relationship. As can be seen from FIG. 1, the vertical distance between successive cartridges in the transition is greater than the vertical distance between successive cartridges in the storage zone 58. In order to best maintain an upward bias on both of cartridges 21*e*, 21*f* in the transition zone 82, a split follower including the first follower 104 and the second follower 106 is used. The first follower 104 and the second follower 106 are movable with respect to each other. Specifically, as the distance between the lowermost cartridge 21*f* and the preceding cartridge 21*e* increases during passage upward through the transition zone 82, the first follower 104, since it is biased separately from the biasing of the second follower 106, is able to slide upwards with respect to second follower 106 so as to constantly maintain contact with the bottom of cartridge 21*e* at the same time that second follower 106 maintains constant contact with the bottom of the lowermost cartridge 21*f*.

As best seen in FIG. 9, the second follower 106 is slideably movable relative to the first follower 104. When the first follower 104 and the second follower 106 are assembled so as to be operatively connected within the housing 60, a first sliding surface 120 of the first follower 124 is adjacent to a first sliding surface 122 of the second follower 106. In order to produce independent biasing of each follower, a window 124 extends through the first follower 104 so that the second follower post 118 may extend therethrough to engage with the hub 112 of the second spring 102. The window 124 is of sufficient vertical extent to accommodate post 118 of the second follower 106 when second follower 106 is in either of its extreme positions with respect to the first follower 104.

The first follower 104 also includes edges 125*a*, 125*b*, 125*c* located at an upper portion thereof. The edges 125*a* and 125*b* each form an angle relative to the edge 125*c*. The edges 125*a* and 125*c* form an angle A while the edges 125*b* and 125*c* form an angle B. These two angles are illustrated diagrammatically in FIG. 9 in that both angles are shown having a greater magnitude than is actually utilized. The angle A is greater than the angle B and this configuration is provided to aid in proper positioning of the uppermost cartridge for delivery into the firearm, as well as to assist in positioning of adjacent cartridge noses in the desired contacting relationship. A slot 127 is formed in the first follower 104 adjacent to its upper portion. The slot 127 enables the follower 104 to move without engaging the projection 93 formed on the second wall first rail 64.

The second follower 106 is provided with first and second channels 126 and 128. These channels are included to accommodate the inward sloping rails. Specifically, as the second follower 106 moves upward through the transition zone 82, the first side wall first rail 54 occupies a progressively more inward (i.e. closer to second side wall 62) position and would contact and interfere with the upward movement of the second follower 106 if no accommodation were made for the first side wall first rail 54. By including a channel 128 in the second follower 106, a space is created within which the first side wall first rail 54 may lie as the second follower 106 moves upward through the transition zone 82. Similarly, the second channel 126 accommodates the inward-sloping first side wall second rail 56 as the second follower 106 moves upward through the transition zone 82.

Figure 18:
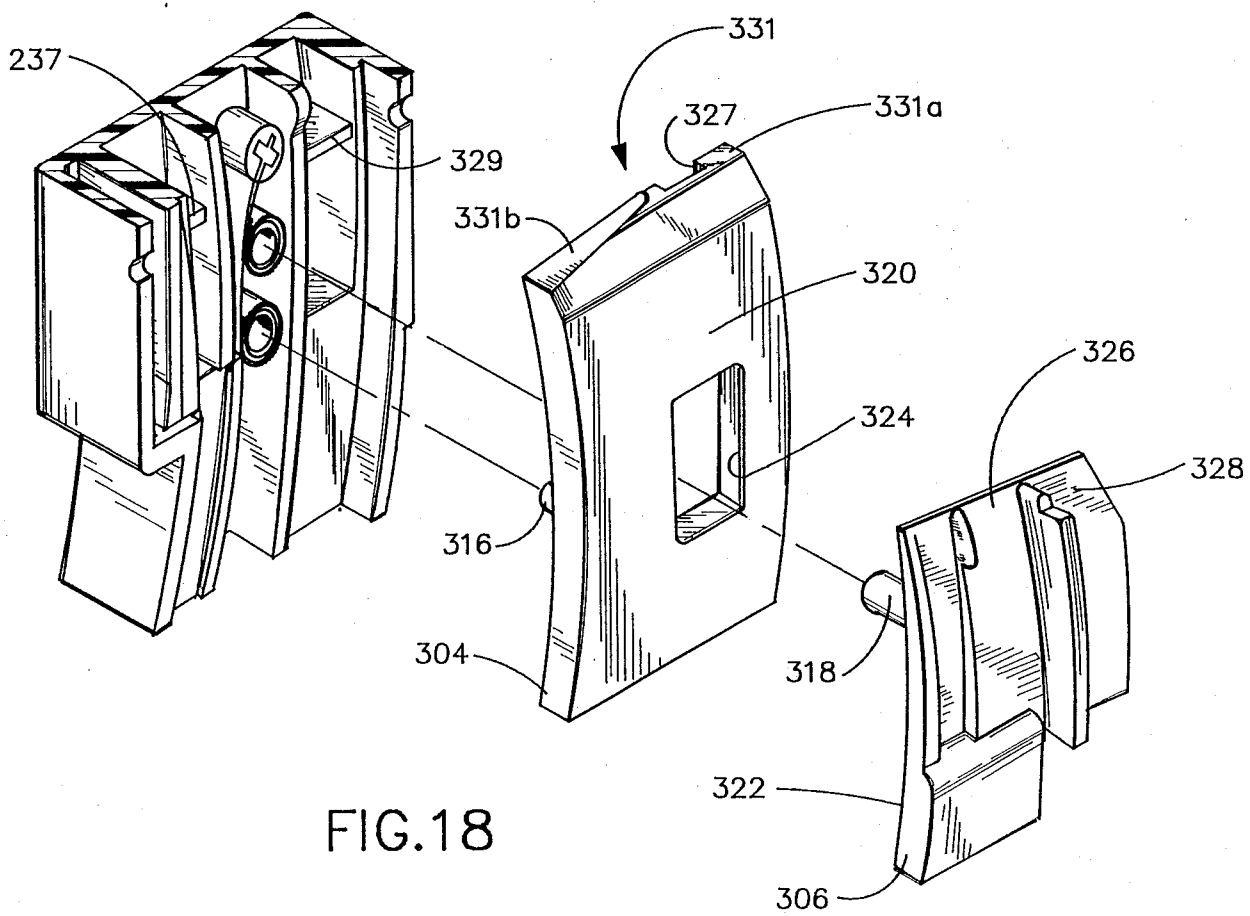
FIG. 18 is an exploded view of the split follower showing debris baffles.

In another embodiment, depicted in FIG. 18, the first and second followers 304, 306 have many of the features of the followers depicted in FIG. 9, including first and second follower posts 316, 318 and sliding surfaces 320, 322 respectively, a first follower window 324 and slot 327 and second follow channels 326, 328. However, the second follower 306 in the embodiment depicted in FIG. 18 has several portions reduced in size in order to provide a follower of reduced size and mass. The first follower 304 has an upper surface 331 which has first and second portions 331*a* and 331*b*. The second portion 331*b* is slanted downward somewhat with respect to the first portion 331*a* in order to cause the last few cartridges, such as the last five cartridges in the magazine, to assume a desired nose-up attitude relative to the positions such cartridges would have if the second portion 331*b* were not slanted downward.

Although the preferred arrangement includes the use of the two followers, it should be understood that the present invention could include, alternatively, a single follower device.

Figure 10:
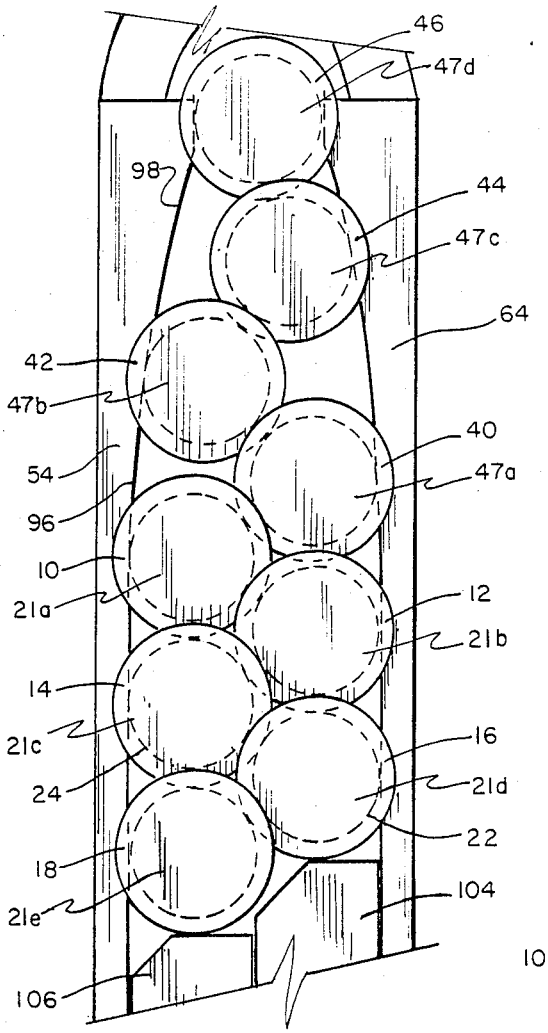
FIG. 10 is an enlarged, fragmentary, sectional view showing another embodiment in which inward sloping of the first rails of both first and second side walls is provided.
Figure 11:
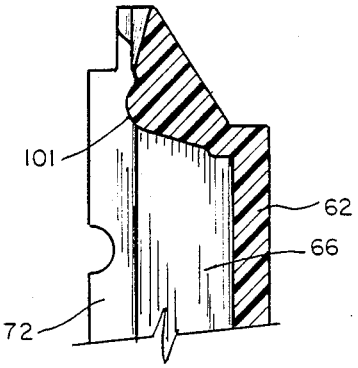
FIG. 11 is a fragmentary, cross-sectional view, taken along lines 11—11 of FIG. 5, showing the restraining member on the second half of the magazine.
Figure 12:
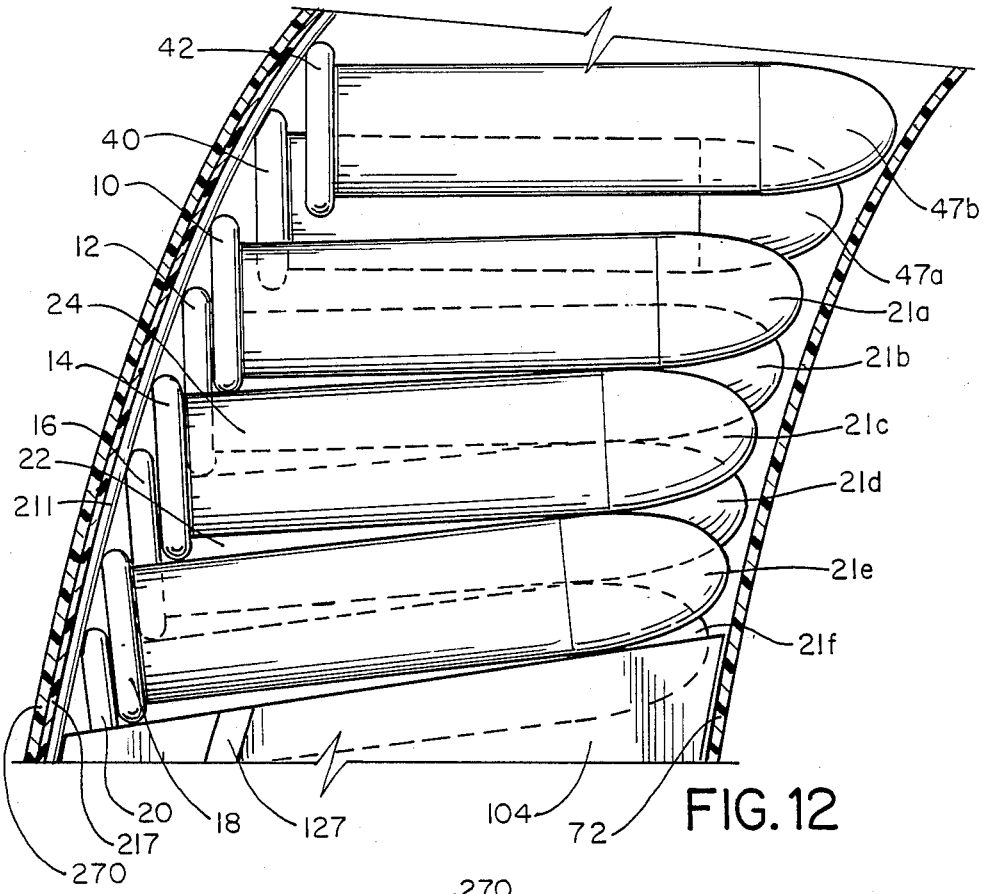
FIG. 12 is an enlarged, fragmentary, cross-sectional view similar to that of FIG. 2 but of another embodiment, showing the positional relationship of cartridges in the storage and transition zones and including rails adjacent to the first end wall.

The present invention can also be implemented with a magazine in which the reduction of thickness is accomplished by the inward sloping of both the first rail 54 and the first rail 64, as illustrated in FIG. 10. In the embodiment depicted in FIG. 10, the slopes of both of the first rails 65, 64 are such that the lateral force imparted to the cartridges as they move into and through the transition zone 82 is controlled to avoid jamming. In this embodiment both followers 104 and 106 will have channels to accommodate the sloping portions of the rails. However, as shown in FIG. 1, in the preferred embodiment, the first rail 64 and second rail 66 do not curve inward but are substantially flat throughout their entire extent. For this reason, it is not necessary to include a channel in the first follower 104 to accommodate the rails in the manner that channels are included in the second follower 106, but only slot 127 need be provided to accommodate projection 93.

In the embodiment shown in FIG. 1 in which the rails on the second side wall are substantially flat throughout their extent, a less complex follower device can be used, compared to the follower used in the embodiment shown in FIG. 10. If reduced thickness in the transition zone 82 is achieved by the inward sloping of rails both on the first side wall 52 and the second side wall 62, as shown in FIG. 10, it is necessary to provide slots to assure that the first follower 104 can travel throughout the full extent of the transition zone 82 to enable ejection of the lowermost cartridge when it reaches the uppermost position in the housing 60. Since, in the preferred embodiment, second side wall rails 64, 66 are in a substantially flat configuration, the first follower 104 can travel the entire extent of the transition zone 82 in a substantially straight manner without the necessity for channeling the first follower 104.

In order to accommodate a number of cartridges which are of a rim-fire or enlarged rim type, the storage zone 58 of the magazine is provided in an arcuate shape. The radius of curvature of this portion of the magazine depends on the type of cartridge being used and particularly the shape of the nose portion of the cartridges, as this shape will define the position along the length of the body of the cartridge where a given cartridge will contact neighboring cartridges. The farther towards the nose of the cartridge that this contact position lies, the larger the radius of curvature. When it is desired that the magazine should accommodate a number of differently-configured cartridges, the radius of curvature of the storage zone 58 should represent an intermediate value, i.e. a value between the radius of curvature which would accommodate only those cartridges whose contact point is most towards the nose of the cartridge and the radius of curvature which would accommodate only those cartridges whose contact point is most towards the rim portion of the cartridges. It has been found that in order for the magazine to accommodate .22 caliber rim-fire cartridges of the types currently made, it is critical that the storage zone have a configuration such that the radius of curvature of the first end wall 70 is 5.29 inches plus or minus 0.25 inch.

The manner of making the magazine will now be described. First and second halves 77*a*, 77*b* of the housing 60 are formed preferably by injection molding and are preferably made of a plastic or plastic-type material. Next, an insert member 217 is formed having at least one and preferably two rails 211, 213 along its longitudinal extent. The insert 217 is preferably formed by injection molding and preferably made of a flexible material. The rails 211, 213 are preferably of a low-friction material. As best seen in FIG. 19, the insert 217 is positioned adjacent to an end wall 270 of the first housing half 77*a*, preferably using the dovetail 219, slot 223, and groove 251 described above. In this configuration, one edge 226 of the plate 217 is received by the first groove 251 and the second edge 228 extends above the edge 230 of the first end wall 270 portion of the first housing half 77*a*. The springs 100, 102 are attached to the anchor 108 and positioned in the sidewall groove 114 of the second half 77*b*. The followers 104, 106 are placed with their posts 116, 118 in operative engagement with the spring hubs 110, 112 as described above. The first and second halves 77*a*, 77*b* are mated along a seam line 78 and connected together, preferably by ultrasonic welding. When the two halves 77*a*, 77*b* are mated, the second edge 228 of the insert 217 is positioned in the groove 253 of the second half 77*b*. In this way, the insert 217 is fixedly held against the first end wall 270.

The manner of use of the magazine of the present invention will not be described. A number of cartridges are inserted into the housing 60 through the opened end of the housing 60. As each cartridge is inserted through the opened end 76, it is forced somewhat forward by the angled third section 90 of the first end wall 70 so that each inserted cartridge automatically assumes the proper nested relationship.

The housing 60 may be fully or partly loaded with cartridges, as is desired. The loaded housing 60 is inserted into a firearm, in a manner well known. Upon operation of the firearm, a mechanism is activated in the firearm to remove the topmost cartridge through the opened end of the housing 76 for firing by the firearm. Upon removal of the topmost cartridge, the plurality of cartridges in the housing 60 is moved through the chamber 80 towards the opened end 76 of the housing by virtue of the force created by the follower device which is biased towards the opened end of the housing 60. This upward movement causes the uppermost of the cartridges which lie in the storage zone 58 to enter the transition zone 82. As cartridges are removed through the opened end 76 of the housing 60 and cartridges move upward through the chamber 80 leaving the storage zone 58 to enter the transition zone 82, the inward sloping configuration of the first side wall first rail 54 creates a lateral force on the cartridges in the transition zone 82. The slope of the first side wall first rail 54 is sufficiently low to control the lateral force so that it does not reach a level where jamming resulting from such a force occurs. As the cartridges move through the chamber 80, the constant upward force created by the follower device maintains the body of each cartridge in contact with the rim of the preceding cartridge so as to maintain the cartridge rims in the nested relationship to prevent cross over and consequent jamming. As the lowermost cartridge 21*f* enters the transition zone 82, and assumes a single file, as opposed to a side-by-side, positional relationship, the first follower 104, being urged upwardly by spring 100 to continuously contact the bottom of cartridge 21*e*, slides upwardly with respect to the second follower 106.

Based on the foregoing detailed discussion of the present invention, a number of advantages of the invention are easily seen. The present invention can be used to store a number of cartridges in a two column configuration in a minimum volume, thus allowing for a side-by-side cartridge housing which minimizes the width and length requirements for a given number of cartridges. The present invention can be used to store rim-fire cartridges while eliminating the possibility of rim cross over and consequent jamming. The present invention can be used to control the amount of lateral force exerted on a cartridge as it is changed from a side-by-side to a rotating, single file relationship so as to eliminate jamming which can result from friction between a cartridge and a side wall or rail. The present invention automatically produces the desired nested relationship of the cartridge rims upon insertion of cartridges into the housing and maintains this nested relationship as the cartridges move through the chamber and are removed from the housing. The present invention can be used to maintain a relatively constant upward force on the cartridges as they move through the chamber, regardless of the change in configuration from a side-by-side relationship to a single file relationship.

Although the present invention has been described with reference to certain embodiments, it should be appreciated that further modifications can be effected within the spirit and scope of the invention. In particular, although the present invention has been described and depicted in relation to a magazine for housing .22 caliber rim-fire cartridges useful in connection with a Ruger 10/22 or 77/22 firearm, it is anticipated that the features of the present invention could be utilized in magazines for use with other cartridges and other firearms.

What is claimed is:

1. An apparatus for use in housing rim-fire cartridges in a side-by-side relationship comprising:

first and second side walls;

first and second end walls, at least a portion of said first end wall being defined by a radius, said radius being about 5.29 inches;

said first and second side walls and said first and second end walls forming a magazine having a chamber, a bottom end, and an opened end, said chamber including a storage zone and a transition zone; and a plurality of rim-fare cartridges, each of said rim-fire cartridges having a rim, a body portion, and a nose end, at least some of said plurality of rim-fire cartridges being contained in said storage zone in a side-by-side relationship, each of said rims of said plurality of cartridges being adjacent to said first end wall.

2. An apparatus for use in housing cartridges in a side-by-side relationship comprising:

first and second side walls;

first and second end walls;

said first and second side walls and said first and second end walls forming a magazine with a longitudinal extent and having a chamber, a bottom end, and an opened end, said chamber including a storage zone and an upper portion adjacent to said opened end;

a plurality of cartridges in said chamber positioned in a nested relationship;

at least a first of said plurality of cartridges having a first configuration;

at least a second of said plurality of cartridges having a second configuration wherein said second cartridge has a shape different from said first cartridge;

means for moving cartridges through said upper portion; and first rail means adjacent to said first side wall and second rail means adjacent to said second side wall for contacting said first and second cartridges to maintain said plurality of cartridges in said nested relationship when said cartridges move through said upper portion, said first rail means including first, second and third rails adjacent to said first side wall in said upper portion, said second rail means including first and second rails adjacent to said second side wall in said upper portion, said second rail of said first rail means being unaligned with and spaced, in a direction substantially transverse to said longitudinal extent of said magazine, from all of said rails of said second rail means including said first and second rails, wherein at least one of said first and second rails of said second rail means and said second rail of said first rail means contact portions of said first cartridge when said first cartridge moves through said upper portion and at least one of said first and second rails of said second rail means and said third rail of said first rail means contact portions of said second cartridge when said second cartridge moves through said upper portion whereby support is provided for both said first and second cartridges even though said second cartridge has a different shape from said first cartridge.

3. An apparatus for use in housing cartridges comprising:

first and second side walls;

first and second end walls;

said first and second side walls and said first and second end walls forming a magazine having a chamber, a bottom end, and an opened end, said chamber including a storage zone and a transition zone;

a first rail projecting inward from said first end wall; and a second rail spaced from said first rail and projecting inward from said first end wall, said first and second rails cooperating to define a region between said first and second rails along said first end wall for holding debris in order to reduce the interference of debris with the movement of cartridges through said chamber.

4. An apparatus for use in housing cartridges comprising:

first and second side walls;

first and second end walls;

said first and second side walls and said first and second end walls forming a magazine having a chamber, a bottom end, and an opened end, said chamber including a storage zone and a transition zone;

a plurality of cartridges in said chamber, each of said cartridges having a rim;

means for moving said cartridges through said chamber;

at least a first rail projecting inward from said first side wall; and means in said chamber for reducing the interference of debris with the movement of cartridges through said chamber, said means for reducing interference including at least a first baffle different from said first rail and projecting inward from said first side wall and extending substantially transverse to said first rail.

5. An apparatus for use in housing cartridges comprising:

first and second side walls;

first and second end walls;

said first and second side walls and said first and second end walls forming a magazine having a chamber, a bottom end, and an opened end, said chamber including a storage zone and a transition zone;

a plurality of cartridges in said chamber, each of said cartridges having a rim;

means for moving said cartridges through said chamber; and means in said chamber for reducing the interference of debris with the movement of cartridges through said chamber, said means for reducing interference including at least one rail projecting inward from a position adjacent to said first end wall and positioned to contact a portion of at least one of said cartridge rims and wherein said one rail is integrally formed on a plate positioned adjacent to said first end wall.

6. An apparatus for use in housing cartridges comprising:

first and second side walls;

first and second end walls;

said first and second side walls and said first and second end walls forming a magazine having a chamber, a bottom end, and an opened end;

a plurality of cartridges, each of said cartridges having a rim, a body portion, a longitudinal axis, and a nose end, at least a first of said plurality of cartridges being positioned adjacent to said opened end; and means for positioning the nose end of said first cartridge in a nose-down configuration, said means for positioning including a lip located adjacent to said opened end and projecting inward and having a lower surface defining an imaginary plane which intersects a line lying along said longitudinal axis of said first cartridge, said lip also having a free end located away from said first end wall and an end located adjacent to said first end wall and in which the length of said free end in a direction substantially along the longitudinal extent of said magazine is greater than the length of said lip end located adjacent to said first end wall whereby said first cartridge is pointed more away from the opened end of the magazine to avoid jamming of cartridges as they move through said magazine.

7. A method for making a magazine for holding cartridges, comprising:

providing a first half of a magazine;

providing a second half of a magazine;

forming an insert member separate from said first and second halves of said magazine, said insert member having at least a first rail located along the longitudinal extent of said insert member;

positioning said insert member adjacent to an end wall of said first half of said magazine; and connecting said first and second magazine halves together with said insert member in position.

8. A method, as claimed in claim 7, wherein:

said connecting step includes ultrasonically welding said first half and second half of said magazine together whereby said insert member is fixedly held against said end wall.

9. An apparatus for use in housing rim-fire cartridges in a side-by-side relationship, comprising:

first and second side walls;

first and second end walls;

said first and second side walls and said first and second end walls forming a magazine having a chamber, a bottom end, and an opened end, said chamber including a storage zone and a transition zone; and an insert member, separate from said side walls and said end walls, said insert member including first and second rails formed along the longitudinal extent of said insert member, said insert member being positioned adjacent to said first end wall for contacting rims of the rim-fire cartridges to facilitate movement thereof in said magazine chamber.

10. An apparatus, as claimed in claim 9, wherein:

said first rail includes an offset portion located in said transition zone, said offset portion being out of line relative to substantially all other portions of said first rail.

11. An apparatus, as claimed in claim 9, wherein:

said first end wall includes a notch formed adjacent to said transition zone for use in holding an end of said insert member.

12. An apparatus, as claimed in claim 9, wherein:

said insert member is made of a flexible material.

13. An apparatus, as claimed in claim 9, wherein:

said bottom end includes a notch for use in holding an end of said insert member.

* * * * *